US006982681B2

(12) United States Patent
Orfei et al.

(10) Patent No.: US 6,982,681 B2
(45) Date of Patent: Jan. 3, 2006

(54) APPARATUS FOR DETECTING ELECTROMAGNETIC RADIATION, IN PARTICULAR FOR RADIO ASTRONOMIC APPLICATIONS

(75) Inventors: Alessandro Orfei, Bologna (IT); Juri Roda, Monghidoro (IT); Giampaolo Zacchiroli, Medicina (IT); Giuseppe Maccaferri, Castel d'Argile (IT); Marco Morsiani, Medicina (IT)

(73) Assignee: C.N.R. Consiglio Nazionale Delle Richerche, Rome (IT)

( * ) Notice: Subject to any disclaimer, the term of this patent is extended or adjusted under 35 U.S.C. 154(b) by 29 days.

(21) Appl. No.: 10/495,477

(22) PCT Filed: Jan. 9, 2003

(86) PCT No.: PCT/IB03/00045

§ 371 (c)(1),
(2), (4) Date: May 13, 2004

(87) PCT Pub. No.: WO03/058761

PCT Pub. Date: Jul. 17, 2003

(65) Prior Publication Data

US 2005/0017913 A1 Jan. 27, 2005

(30) Foreign Application Priority Data

Jan. 11, 2002 (IT) ..... BO2002A0012

(51) Int. Cl.
*H01Q 15/20* (2006.01)
*H01Q 21/24* (2006.01)

(52) U.S. Cl. ..... 343/915; 342/361

(58) Field of Classification Search ..... 343/757, 343/758, 761, 781 P, 912, 915; 342/361, 342/367, 359
See application file for complete search history.

(56) References Cited

U.S. PATENT DOCUMENTS 4,811,033 A * 3/1989 Ahl et al. ..... 343/880
5,162,811 A * 11/1992 Lammers et al. ..... 343/915
5,440,320 A * 8/1995 Lach et al. ..... 343/915
5,864,324 A * 1/1999 Acker et al. ..... 343/915

FOREIGN PATENT DOCUMENTS

EP 0 438 664 7/1991

OTHER PUBLICATIONS

Monk, A. D., et al., "Adaptive null formation with a reconfigurable reflector antenna". IEE Proc.-Microw. Antennas Propag., vol. 142, No. 3, Jun. 1995, pp. 220-224.

* cited by examiner

*Primary Examiner*—Shih-Chao Chen
*Assistant Examiner*—Minh Dieu A
(74) *Attorney, Agent, or Firm*—Nath & Associates PLC; Gary M. Nath; Gregory B. Kang

(57) ABSTRACT

The apparatus for detecting electromagnetic radiation (300), in particular for radio astronomic applications, comprises a receiving element (10), and a plurality of reflecting elements (20) forming a surface (30), capable of receiving the electromagnetic radiation (300) and to direct it at the receiving element (10) The apparatus (1) further comprises a plurality of actuators (40) used to vary the position of the reflecting elements (20) and a plurality of smart circuit blocks (60), each designed to receive as input a control signal (loo) from a processing unit (50) and to generate as output a corresponding displacement parameter (101) used by an actuator (40) to position the reflecting elements (20) connected to it.

35 Claims, 6 Drawing Sheets

APPARATUS FOR DETECTING ELECTROMAGNETIC RADIATION, IN PARTICULAR FOR RADIO ASTRONOMIC APPLICATIONS

The application is a 371 of PCT/IB03/00045 Jan. 9, 2003.

TECHNICAL FIELD

The present invention relates to an apparatus for detecting electromagnetic radiation, in particular for radio astronomic applications.

BACKGROUND ART

As is known, there are several different kinds of devices used to detect radiation from celestial objects.

The most common of these devices consist essentially of a parabolic surface made of materials capable of reflecting the radiation concerned (ranging in frequency from a few Ghz to several hundred Ghz), and a receiver positioned at the focus of the parabolic surface.

Using this structure and according to well-known physics laws, the radiation striking the inside surface of the parabolic reflector is reflected at an angle which directs it to the receiving element.

The latter, after detecting the incident radiation, sends corresponding signals containing information about the radiation, to a study centre where the information is analysed and processed.

To capture radiation from different zones in space, prior art parabolic aerials are equipped with drive means designed to vary the angle of the parabolic structure in such a way that its inside surface faces different objects in space.

When the angle of the aerial is varied, however, the parabolic surface is deformed on account of the weight of the aerial's load bearing structure.

Indeed, prior art parabolic aerials are constructed in such a way as to have a nearly perfect parabolic shape at a predetermined angle (usually 45° relative to the ground). When this angle has to be changed, the different components of the structure are subjected to varying gravitational stresses which change the position and angle of the components relative to each other and thus deform the initial parabolic arrangement.

It is evident that this deformation has a negative effect on the receiving performance of the aerial since the incident radiation is no longer directed at the receiving element with the same degree of precision. This means that the intensity of the signal received is greatly reduced (also bearing in mind that the signals come from very distant sources and, therefore, are in themselves very weak).

Moreover, the higher the reception frequency, the greater the negative effect is on the strength of the signal received.

To overcome this problem, prior art teaches the use of active surfaces constructed using a plurality of mobile reflecting surfaces placed side by side in such a way as to form the parabolic structure.

The reflecting elements are usually square or rectangular panels placed edge to edge in such a way as to form a practically uninterrupted surface. By moving the reflecting elements, as explained below, the initial shape of the surface can be maintained practically unchanged, even in the presence of varying gravitational stresses.

The structure is equipped with a plurality electromechanical actuators designed to vary the positions of the reflecting elements in accordance with appropriate control signals.

These actuators consist of an electric motor, usually a DC motor, and a piston, driven by the motor, that moves in the direction defined by the longitudinal extension of the piston itself. The upper end of each piston is connected to one or more reflecting elements whose positions are thus varied by the action of the motor.

The system that controls these movements through the aforementioned control signals includes a processing unit that generates the control signals by which the extent of the movement that each piston must perform (to position the reflecting elements) is communicated to each actuator in order to compensate for the deformation of the active surface due to gravitational stresses.

Thus, whatever the angle of the aerial, the reflecting elements can adjust their positions in such a way that the inside surface of the structure retains the ideal shape at all times, that is to say, a shape which is substantially that of a paraboloid of revolution whose curvature is appropriately adapted to improve the receiving performance of the apparatus.

A major disadvantage of systems such as that just described lies in the fact that all the actuators are directly connected to the processing unit and are directly addressed by the processing unit every time the reflecting elements need to be repositioned. In other words, once the processing unit has selected from its internal table the displacements required for each actuator, it sequentially selects the outputs by which it is connected to the actuators and, through these, transmits the necessary information to each actuator.

A solution of this kind necessarily involves the use of an inordinate quantity of cables since the direct connection of all the actuators to the processing unit requires several dozens of kilometers of cables (up to as much as around 160 km of cables for aerials 100 metres in diameter).

Moreover, the use of cables of considerable length to transmit signals directly to the processing unit of each single motor may contribute to the creation of significant RF interference between the control signals themselves, thus preventing not only the correct operation of the entire adjustment system but also the proper reception of weak radio astronomic signals.

DISCLOSURE OF THE INVENTION

Therefore, the aim of the present invention is to overcome the above mentioned disadvantages.

More specifically, the invention has for an object to provide an apparatus for detecting electromagnetic radiation, in particular for radio astronomic applications, that significantly reduces the total length of the cables used.

Another object of the invention is to provide an apparatus for receiving electromagnetic radiation that minimises the interference between the control signals which the processing unit addresses to the actuators.

The present invention also has for a secondary object to provide an apparatus for receiving electromagnetic radiation where both the actuators and the network of connections to the processing unit have a simple structure so that, in the event of a fault or malfunction, the point where maintenance is required can be located and accessed quickly and easily.

Another object of the invention is to improve the reception capabilities of radio astronomic aerials currently in existence so as to permit the reception of signals whose frequency is much higher than that of signals that can be received by current systems.

Yet another object of the invention is to provide a control system for radio astronomic receiving apparatus that can be easily applied to existing apparatus without necessitating significant and expensive modifications to the structure of the existing aerial.

BRIEF DESCRIPTION OF THE DRAWINGS

Other technical characteristics of the invention and its advantages will become more apparent from the detailed description, set out below, of a preferred non-restricting embodiment of the apparatus for detecting electromagnetic radiation, in particular for radio astronomic applications illustrated in the accompanying drawings, in which.

DETAILED DESCRIPTION OF THE PREFERRED EMBODIMENTS OF THE INVENTION

In the accompanying drawings, the apparatus for detecting electromagnetic radiation according to the present invention is denoted in its entirety by the numeral 1.

Figure 1:
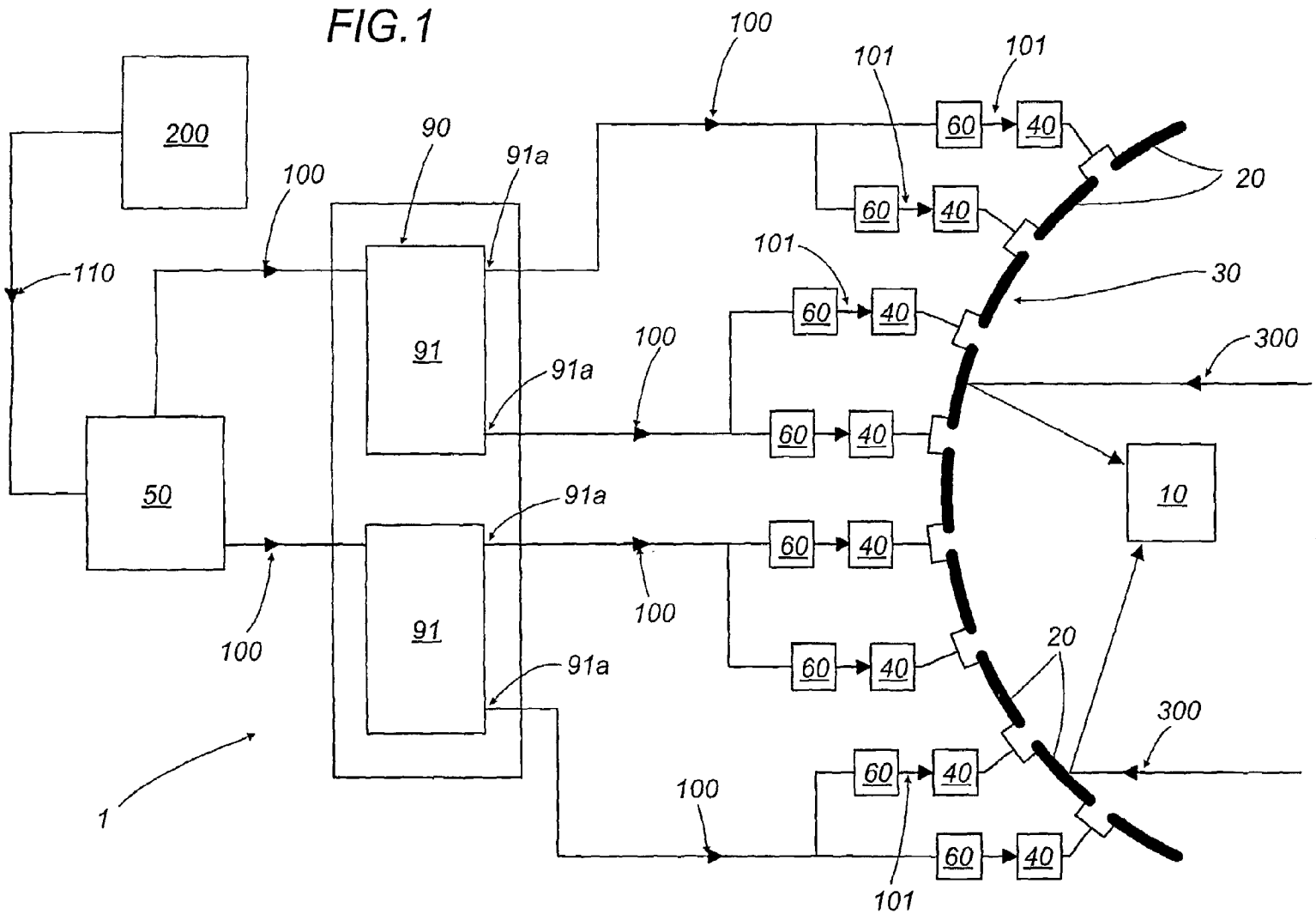
FIG. 1 is a block diagram of an apparatus according to the present invention.

With reference in particular to FIG. 1, the apparatus 1 basically comprises a receiving element 10 designed to detect electromagnetic radiation 300, for example from celestial objects.

The radiation 300 normally ranges in frequency from a few Ghz to several hundred Ghz.

The receiving element 10 generates output signals according to the radiation 300 received and addresses these signals to a reception and processing centre where they are analysed in order to obtain desired information.

In order to direct the electromagnetic radiation 300 at the receiving element 10, the apparatus 1 further comprises a surface 30, whose shape is preferably like that of a paraboloid of revolution and whose curvature can be suitably adjusted to optimise the performance of the aerial.

Thanks to its reflective properties, the surface 30 directs the incident electromagnetic radiation 300 at the receiving element 10.

Advantageously, the surface 30 consists of a plurality of reflecting elements 20 which are associated with each other in such a way as to form the surface 30 itself.

More specifically, each reflecting element 20 has a substantially plate-like structure and is positioned side by side 35 with other adjacent reflecting elements 20 in order to form the surface 30.

In a preferred embodiment, the reflecting elements 20 are substantially trapezoidal in shape and are positioned edge to edge.

The choice of a structure of this kind makes it possible to correct the shape of the surface 30, for example, to compensate for deformation caused by the gravitational stress to which the surface 30 is subjected when its angle is varied.

To perform corrections of this kind, the apparatus 1 further comprises a plurality of actuators 40.

Each actuator 40 is positioned close to at least one respective reflecting element 20 and operates in such a way as to vary the latter's position.

In practice, each actuator 40 is connected to one or more of the reflecting elements 20 constituting the surface 30 and is designed to vary the position of the reflecting elements 20 to which it is connected in accordance with the corrections required.

Figure 2:
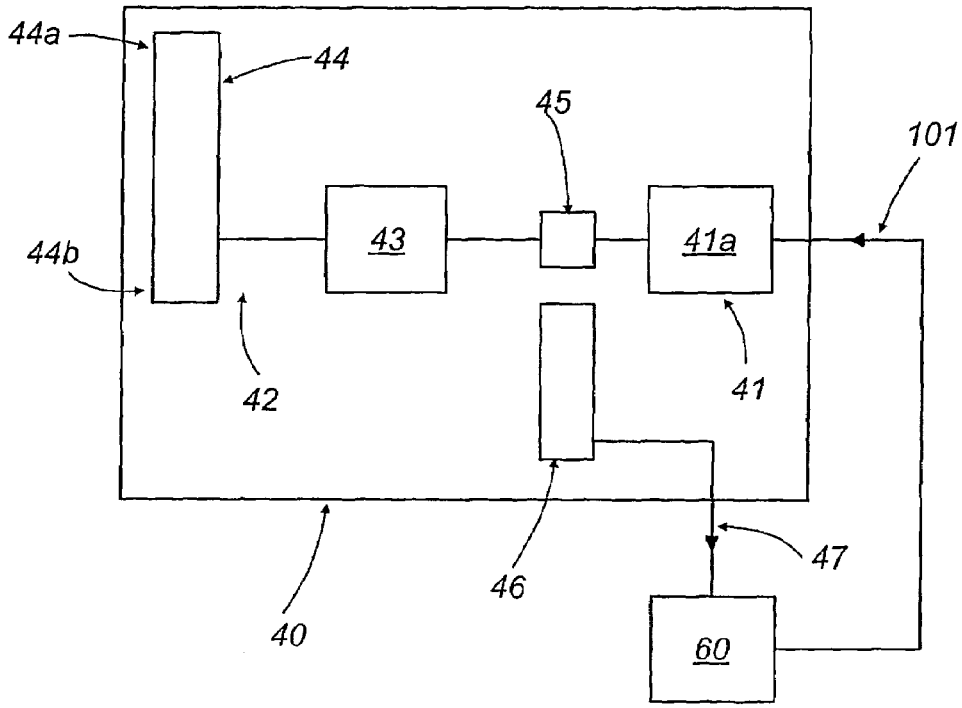
FIG. 2 is a block diagram of an actuator forming part of the apparatus of FIG. 1.

Looking in more detail with reference to FIG. 2, each actuator 40 comprises a drive unit 41 and mechanical transmission means 42. The latter are connected to the respective drive unit 41 and reflecting elements 20 and transmit to the reflecting elements 20 the motion generated by the drive unit 41.

More specifically, the mechanical transmission means 42 can be moved between a plurality of working positions, each of which corresponds to at least one predetermined position of the reflecting elements 20 connected to the mechanical means 42 themselves.

In other words, the mechanical transmission means 42 move to different positions in accordance with the control signals received from the drive unit 41. Consequently, the reflecting elements 20 connected to the mechanical transmission means 42 also move to different positions accordingly.

Still with reference to FIG. 2, the mechanical transmission means 42 comprise a conversion mechanism 43, connected to the drive unit 41 and designed to convert the rotational motion generated by the drive unit 41 into the translational motion of a transmission element 44 connected to the mechanism 43.

Figure 7:
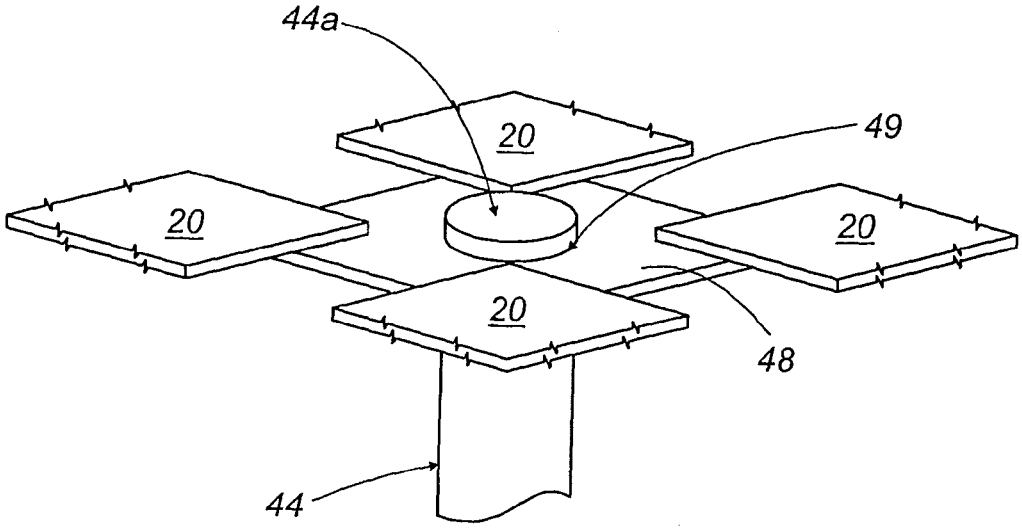
FIG. 7 is a perspective view of a part of an actuator of the apparatus of FIG. 1.

The transmission element 44 has preferably an elongated shape (see FIG. 7). A first end 44*a* of the transmission element 44 is connected to the reflecting elements 20 controlled by the drive unit 41, whilst a second end 44*b* of the transmission element 44 is connected to the conversion mechanism 43.

Thanks to this structure, the rotational motion typical of an electric motor 41*a*, for example, can be used to obtain a translational motion of the transmission element 44. Thus the latter is moved substantially in a direction parallel to its longitudinal extension. These movements are used to adjust the position (and, in particular, the angle) of the reflecting elements 20 connected to the element 44.

To connect the transmission element 44 to the respective reflecting elements 20, the mechanical transmission means 42 further comprise a link plate 48. The link plate 48 is fixed to the first end 44*a* of the transmission element 44 and connected to the respective reflecting elements 20.

Figure 7A:
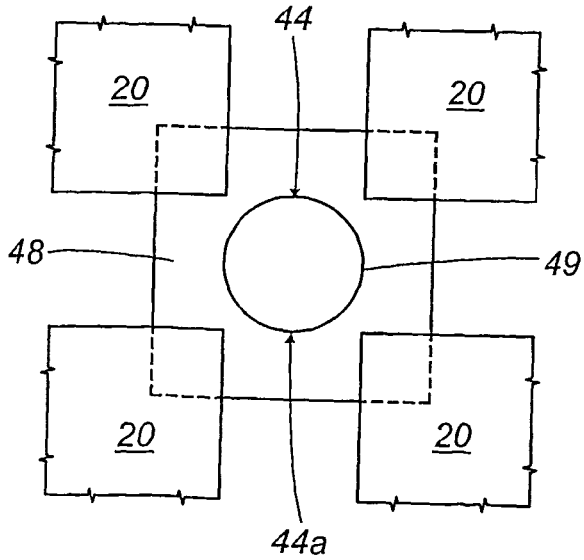
FIG. 7*a* is a plan view of the elements illustrated in FIG. 7.

With reference in particular to FIGS. 7 and 7*a*, the link plate 48 presents a main through hole 49 in a substantially central position of it.

The elongated transmission element 44 is mounted in the main through hole 48 in such a way as to make a fixed connection with the link plate 48.

The link plate 48 is in turn connected to a plurality of reflecting elements 20.

In practice, the transmission element 44 consists of a rod connected at one end 44*b* to the electric motor 41*a* and, at the opposite end 44*a*, to the link plate 48.

The latter is preferably square in shape. A reflecting element 20 is connected to each of the four corners of the link plate 48.

Thus, each reflecting element 20 is connected to four different actuators 40, one at each of its four corners. As mentioned above, the reflecting elements 20 are preferably trapezoidal in shape.

In this way, a longitudinal displacement of the rods 44 can be used to obtain a variation in the position and angle of each of the reflecting elements 20.

As explained in more detail below, these variations are measured and processed by an appropriate control system.

Thus, the apparatus 1 (see FIG. 1) is equipped with a processing unit 50 connected to the actuators 40 and conveniently positioned close to the surface 30. The processing unit 50 sends to the actuators 40 appropriate control signals 100 in order to enable the drive units 41 of the actuators 40 to move the transmission means 42 connected to them and, consequently, to drive the reflecting elements 20.

Figure 4:
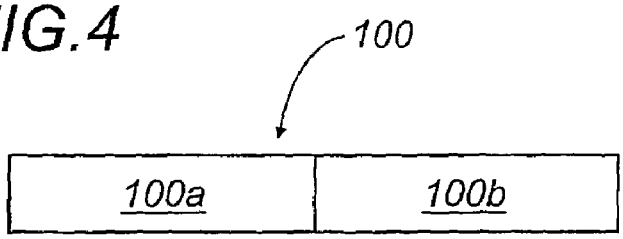
FIG. 4 illustrates the logical structure of a signal used in the apparatus of FIG. 1.

Each control signal 100 incorporates, as shown schematically in FIG. 4, a positioning parameter 100*a* that defines an operating position of the transmission means 42 of a target actuator 40, and, preferably, an identification code 100*b* that identifies the target actuator 40.

Thus, when it becomes necessary to move one or more reflecting elements 20, the processing unit 50 generates the control signals 100. In order to enable the required movements to be performed, each control signal 100 (see FIG. 4) contains the identification code 100*b* of the target actuator 40 to which the control signal is addressed, and a positioning parameter 100*a* defining the working position to which the transmission means 42 of the target actuator 40 must move.

In order to connect the processing unit 50 in a practical and functional manner to all the actuators 40, the apparatus 1 also comprises a plurality of smart circuit blocks 60, each of which is associated with a corresponding actuator 40.

More specifically, each smart circuit block 60 is located between the processing unit 50 and the drive unit 41 of the corresponding actuator 40. Each circuit block 60 is designed to receive as input a control signal 100 from the processing unit 50 and to output a corresponding displacement parameter 101.

The latter is input to the drive unit 41 of the corresponding actuator 40 and is used to apply a movement to the reflecting elements 20 controlled by said actuator 40.

Advantageously, at least one of the smart circuit blocks 60 is positioned close to the drive unit 41 of the actuator 40 associated with that circuit block 60. More specifically, each of a predetermined number of the smart circuit blocks 60 may be positioned close to the drive unit 41 of the actuator 40 associated with that circuit block 60.

In a preferred embodiment, each of the smart circuit blocks 60 is positioned close to the drive unit 41 of the actuator 40 associated with it.

Figure 5:
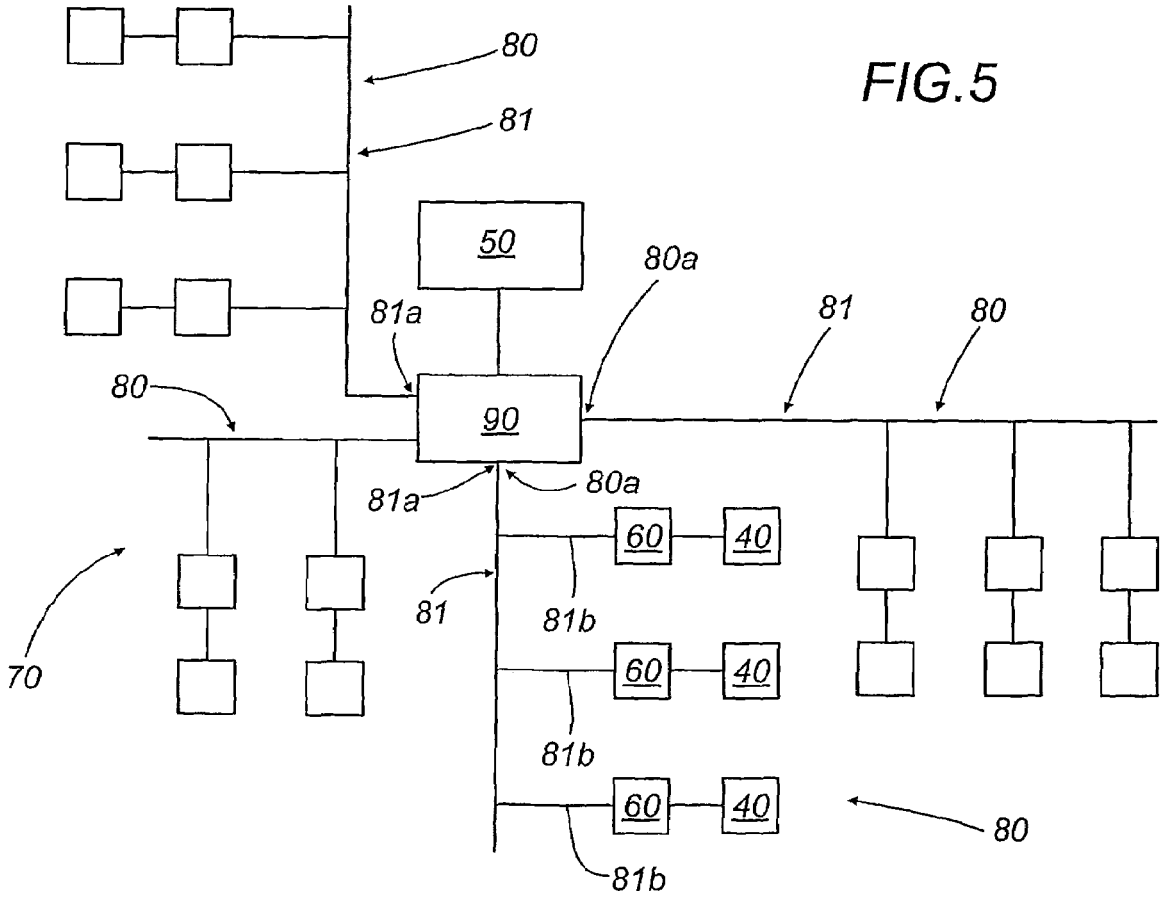
FIG. 5 is a detailed block diagram of a part of the apparatus of FIG. 1.

As can be seen in FIG. 5, the actuators 40 are positioned according to a radial structure 70 defined by a plurality of branches 80, each of which has one end 80*a* connected to the processing unit 50 through an interface unit 90, described in more detail below, and which consists of a predetermined number of actuators 40 arranged in sequence.

In other words, to minimise the resources to be invested in cables and, at the same time, to obtain reliable and efficient connections, the actuators 40 are aligned according to a plurality of branches 80, each of which is connected at one end 80*a*, to the processing unit 50 through the interface unit 90, as mentioned above.

To connect all the actuators 40 belonging to one branch 80, the apparatus 1 comprises a plurality of transmission channels 81, each of which is associated with a respective branch 80. Each transmission channel 81 has an input 81*a* connected—again through the interface unit 90—to the processing unit 50, in order to receive from the latter the control signals 100, and a plurality of legs 81*b* each of which connects it to the smart circuit block 60 of each of the actuators 40 belonging to the branch 80.

Figure 6:
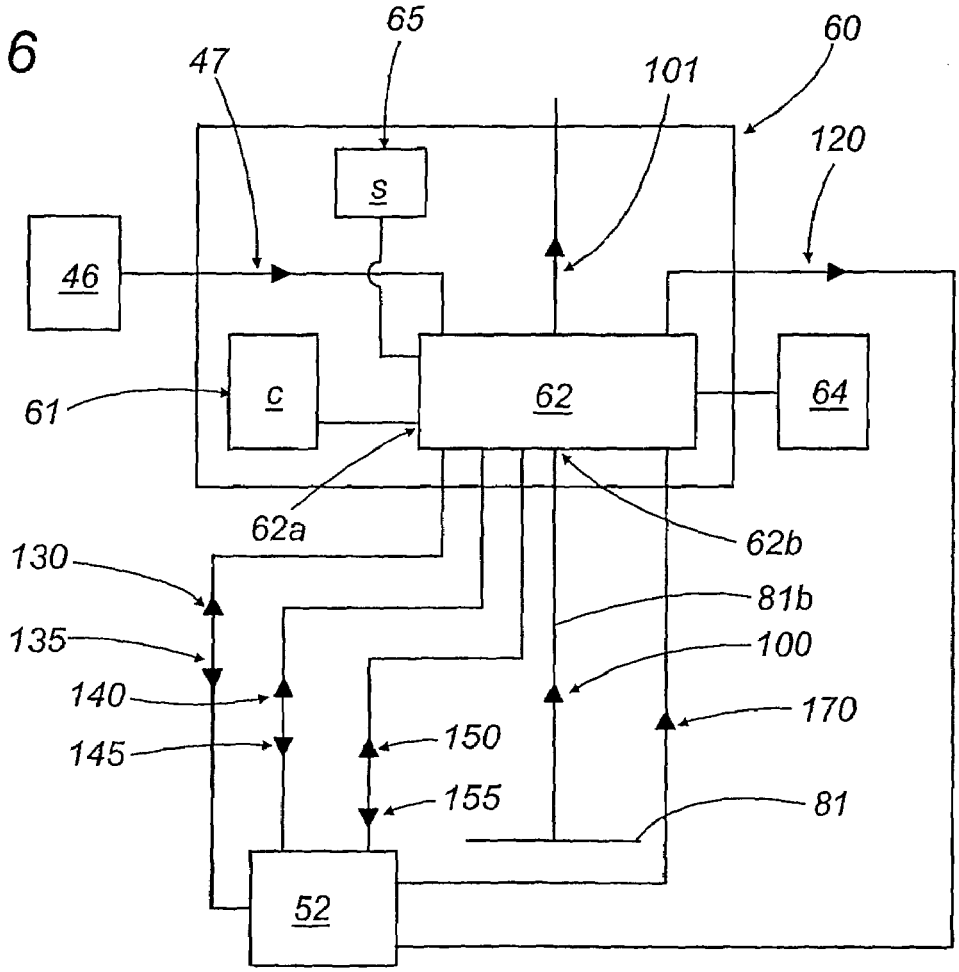
FIG. 6 is a block diagram of a component of the apparatus of FIG. 1.

With reference in particular to FIG. 6, each smart circuit block 60 comprises a main memory unit 61 designed to store the identification code "c" of the actuator 40 associated with that circuit block 60.

As explained in more detail below, a component of this kind is necessary to enable each circuit block 60 to recognise the control signals 100 addressed to the actuator 40 associated with it.

Each circuit block 60 also includes a processing circuit 62 having a first input 62*a* connected to the main memory unit 61 and at least one second input 62*b* connected to one of the connecting legs 81*b* in order to receive the control signals 100.

Thanks to the structure and connections described above, at least one of the control signals 100 is input to the processing circuit 62 which compares the identification code 100*b* contained in the control signal 100 with the identification code "c" stored in the main memory unit 61.

If the two identification codes match, the processing circuit 62 outputs a displacement parameter 101 which is input to the drive unit 41 of the actuator 40, so as to move the reflecting elements 20 associated with the actuator 40.

In order to enable the control signals to reach each actuator 40, as mentioned above, the apparatus 1 comprises an interface unit 90, allowing communication between the processing unit 50 and the smart circuit blocks 60 of the actuators 40 and preferably positioned close to the processing unit 50.

The interface unit 90 is equipped with a plurality of addressing blocks 91, each of which is connected to the processing unit 50 and receives as input one of the control signals 100.

Each addressing block 91, advantageously consisting of a demultiplexer, is also equipped with a plurality of outputs 91*a*, each of which is connected to a corresponding transmission channel 81.

Thus, when a control signal 100 is input to an addressing block 91, the latter can output it to the branch 80 to which the target actuator 40 belongs.

Thus, the processing unit 50 addresses the control signals 100 by first selecting the addressing block 91 to be used. The selected addressing block 91 then sends the control signal to the appropriate branch 80 through the respective transmission channel 81.

Finally, the control signal 100 is received by each of the actuators 40 connected to that transmission channel 81 and each of them, through the smart circuit block 60 structure associated with it, performs the comparison operation described above so that only the drive unit 41 of the target actuator 40 actually receives the control signal and performs the required movement.

As mentioned above, the processing unit 50 is advantageously positioned close to the surface 30.

In order to control the positioning of the reflecting elements 20 from a remote location, the apparatus 1 is equipped with an auxiliary processor 200 that may be positioned at a preset distance from the surface 30.

The auxiliary processor 200 is designed to send to the processing unit 50 an auxiliary signal 110 containing at least one auxiliary parameter 110*a*.

The purpose of the auxiliary parameter 110*a* is to identify a position of the surface 30. In other words, the angle at which the surface 30 must be positioned is selected at the auxiliary processor 200.

Then, as described below, the processing unit 50 uses this information to move the individual actuators 40.

Figure 3:
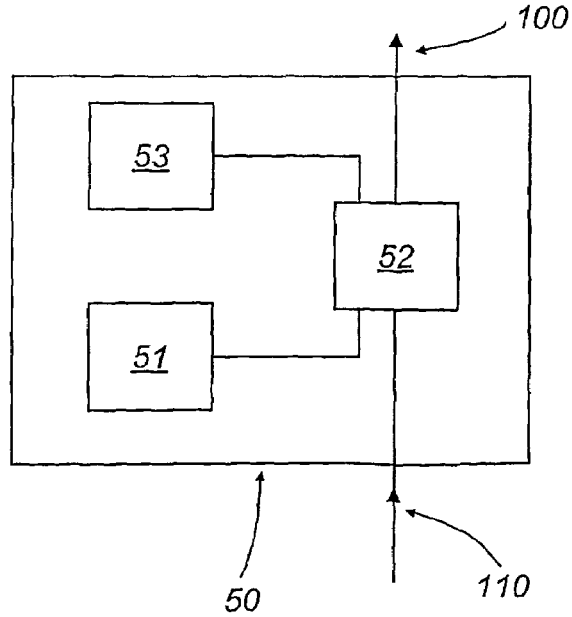
FIG. 3 is a block diagram of a component of the apparatus of FIG. 1.

To do this, the processing unit 50, schematically illustrated in FIG. 3, has an associative memory unit 51, where all the necessary data is stored.

Figure 8:
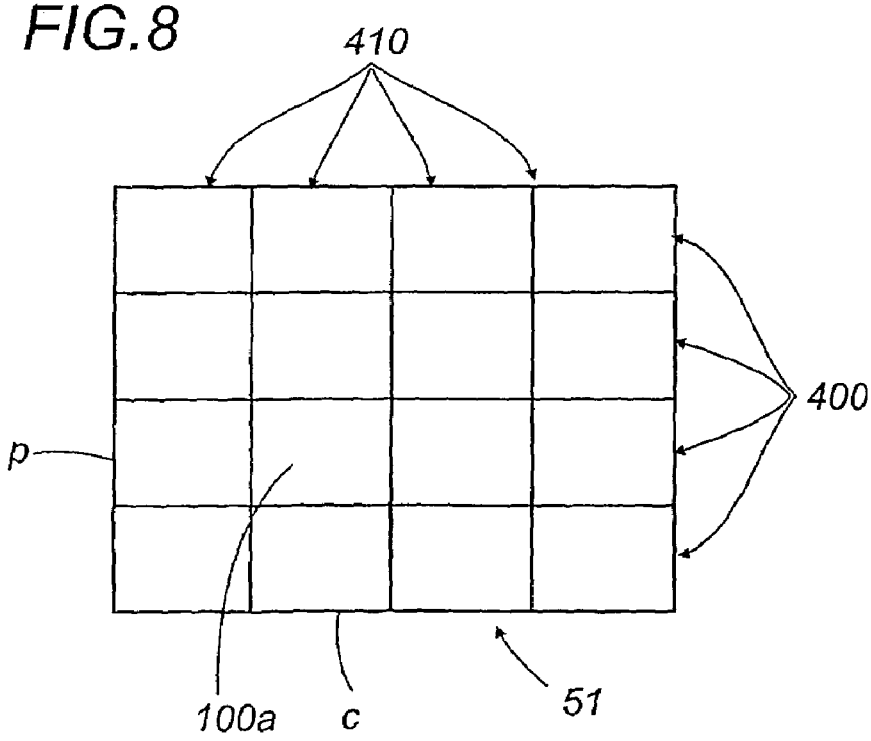
FIG. 8 illustrates the logical structure of a memory unit used in the apparatus of FIG. 1.

More specifically (see FIG. 8), the associative memory unit 51 is designed to contain a plurality of records 400, each of which is identified by a main parameter "p", corresponding to a defined position of the surface 30.

Each record 400 consists of a plurality of fields 410. Each field 410 is defined by the identification code "c" of an actuator 40 and contains a positioning parameter 100*a* that identifies a position of the mechanical transmission means 42 of that actuator 40, this position of the mechanical transmission means 42 corresponding to the above mentioned defined position of the surface 30.

In practice, the associative memory unit 51 is organised like a table where each row consists of a record 400 and is identified by a main parameter "p" which associates the row with a position of the surface 30.

Each row consists of a sequence of fields, each containing one positioning parameter 100*a* of the mechanical transmission means 42 for each actuator 40. Each positioning parameter 100*a* is associated with an actuator 40 through the identification code "c" of that actuator 40.

In order to correctly manage the data it receives and the programmed data in it, the processing unit 50, further comprises a CPU 52, connected to the associative memory unit 51 and designed to perform all the functions necessary to transmit the control signals to the actuators 40.

Thus, the CPU 52, after receiving the auxiliary signal 110, compares the auxiliary parameter 110*a* with the main parameters "p" present in the associative memory unit 51. If the auxiliary parameter 110*a* matches a defined main parameter "p", the record 400 identified by the defined main parameter "p" is selected from the associative memory 51.

This record 400 contains the positioning parameters 100*a* for the mechanical transmission means 42 of the actuators 40 and corresponding to the selected position of the surface 30.

The CPU 52 then generates a control signal 100 corresponding to the auxiliary signal 110*a* received.

The control signal 100 contains the positioning parameters 100*a* present in the selected record 400, each associated with the identification code "c" of the respective actuator 40.

Thus, the control signal 100 consists of a plurality of portions, each (see FIG. 4) containing a positioning parameter 100*a* and an identification code 100*b* of a target actuator 40.

The control signal thus generated is sent to the appropriate addressing block 91, so that it can be transmitted to the target actuator 40 and the respective drive unit 41 can operate accordingly.

At times, the step-motor 41*a*, which constitutes the drive unit 41, may not operate correctly, that is to say, the step-motor 41*a* may "break step" or "undershoot".

That means that the number of steps (or revolutions) required by a control signal 100 to perform a certain movement does not exactly match the number of steps (or revolutions) actually performed by the motor in response to the control signal.

To avoid the possibility, however remote, of the step motor 41*a* "breaking step" (or "undershooting"), that is to say, of its failing to perform the required movement correctly, the unit 40 and the unit 60 have a built-in device designed to rapidly detect malfunctions of this type.

Each smart circuit block 60 (see FIG. 6) is equipped with a counting register 64, in which a defined value, representing the number of steps that the motor 41*a* must perform, is stored.

This defined value corresponds to the positioning parameter 100*a* contained in the main signal 100 generated by the processing unit 50.

Thus, after the main signal 100 has been received, the number of steps that the motor 41*a* is supposed to perform is set in the counting register 64.

To check that the step-motor 41*a* executes the command correctly, there is a cam 45 attached to a shaft of the step-motor 41*a* itself (see FIG. 2). The cam 45 is coupled with a detection device 46, preferably of optical type, located at the step-motor 41*a*.

Each revolution of the shaft of the step-motor 41*a* corresponds to a rotation of the cam 45 through a preset number of angular positions.

The detection device 46, which advantageously consists of a photocell, is designed to detect the position of the cam 45 at at least one defined angular position and to send to the smart circuit block 60 one or more corresponding electric positioning pulses 47.

In practice, when movement starts, the cam 45 is located at the defined angular position, that is, facing the photocell of the device 46. When the command received through the main signal 100 has been executed, there are two possibilities: the cam is once again at the defined angular position where it faces the photocell, or it is at a different position where it does not face the photocell.

If the cam 45 is located once again in the defined angular position, the detection device 46 generates the above mentioned positioning pulses 47, preferably electrical, to communicate the information to the smart circuit block 60. The latter, as mentioned above, is equipped with a processing circuit 62 designed to receive the pulses 47. The processing circuit 62 also reads the counting register 64 which contains the preset value representing the number of revolutions that the step-motor 41*a* is required to perform.

Once the command has been executed, the processing circuit 62 compares the information received through the pulses 47 with the value in the counting register 64. If the two values do not match, a fault signal 120 is sent to the processing unit 50.

More specifically, the processing circuit 62 takes the preset value from the counting register 64 and compares it with the whole number part of it, preferably by a division operation. In this way, it determines whether the number of revolutions that the step-motor 41*a* was required to perform was a whole number or not. That is because the preset value in the counting register 64 represents the exact movement required of the drive unit 41, including fractions of a revolution which the motor 41*a* must perform in order to position the transmission means 42 correctly.

The processing circuit 62 therefore compares the information in the counting register 64 (whether the number of revolutions required is a whole number or not) with the signal received from the detection device 46 (whether, after the command has been executed, the cam 45 faces the photocell or not).

If the pulses 47 have been received but the number of revolutions was not a whole number, or if the pulses 47 have not been received, but the number of revolutions was a whole number, the processing circuit 62 generates a fault alert signal 120 so that personnel can check the reason for the inconsistency in the processed data.

In a preferred embodiment, the cam 45 is made in such a way as to occupy a defined angular interval (for example, 60°). Thus, the position of the cam 45 is not detected relative to a precise angular position but relative to an angular interval corresponding to that occupied by the cam 45 itself.

As a further test on the operation of the apparatus 1 as a whole, the processing unit 50 periodically polls the smart circuit blocks 60 to get information about the actuators 40 connected to them.

In particular, with reference to FIG. 6, the CPU 52 of the processing unit 50 can send a first polling signal 130 to one or more of the smart circuit blocks 60 to obtain information relating to the operating state of the corresponding actuators 40.

Each actuator 40 can be in one of two different conditions, namely: an operative condition, in which a movement of the transmission means 42 can be effected by the drive unit 41; and a non-operative condition in which the actuator 40 is disabled, that is to say, in which the corresponding transmission means 42 cannot be moved. Usually, an actuator 40 is in the non-operative condition when, for example on account of a fault or other malfunction, it cannot perform the required drive operations.

To store the state of each actuator 40, each smart circuit block 60 has a status register 65 which contains a status parameter "s" representing the operating condition of the actuator 40 connected to that block 60. In practice, the status parameter "s" consists of a bit that has the value 1 or 0 depending on the condition of the actuator 40.

The first polling signal 130 generated by the CPU 52, as mentioned above, is received by the processing unit 62 of the target smart circuit block 60. This causes the circuit 62 to read the status register 65 and generates a first response signal 135 addressed to the processing unit 50 and containing the status parameter "s".

In this way, the CPU 52 receives at defined intervals the first response signals 135 containing information relating to the operating state of the individual actuators 40.

Advantageously, the processing unit 50 also includes a status memory unit 53 (see FIG. 3), designed to store the data relating to the operating states of the actuators 40. The status memory unit 53 is logically structured like a table containing a set number of defined parameters, each representing the operating state of an actuator 40. Each time the CPU 52 receives a first response signal 135, it compares the status parameter "s" with the parameter in the status memory unit 53 representing the state of the actuator 40 from which that first response signal 135 comes. If the two data items do not match, the CPU 52 can correct the status memory unit 53 in accordance with the new information received.

Another test that is performed is to ensure that the processing circuit 62 correctly reads the counting register 64.

For this purpose, the CPU 52 sends to the processing circuit 62 a second polling signal 140. On receiving the second polling signal 140, the circuit 62 reads the defined value stored in the counting register 64 and generates as output a second response signal 145, containing this defined value so that the processing unit 50 can receive the information.

Conveniently, the CPU 52 can also compare the data received through the second response signal 145 with the data stored in the associative memory unit 51. More specifically, the CPU 52 is designed to compare the defined value received through the second response signal 145 with the corresponding parameter 100*a* contained in the associative memory unit 51, that is, the positioning parameter 100*a* related to the actuator 40 connected to the smart circuit block 60 from which the second response signal 145 comes.

Alternatively or in addition to the test routines described above, the consistency between the defined value in the counting register 64 and the position of the cam 45 may also be tested periodically.

Thus, the CPU 52 is designed to send to one or more of the smart circuit blocks 60 a third polling signal 150. On receiving the third polling signal 150, the processing circuit 62 generates a corresponding third response signal 155 to communicate to the processing unit 50 information on whether or not the processing circuit 62 itself has received the pulses 47.

Depending on requirements, the third response signal 155 may contain a parameter indicating whether the pulses 47 have been received or not, or a parameter representing the consistency/inconsistency between the data in the counting register 64 and the position of the cam 45. In the former case, the CPU 52 must process and combine the information relating to the revolutions of the motor 41*a* counted and the position of the cam 45 in order to detect inconsistencies, if any.

In the light of the above, it is evident that the polling signals 130, 140 and 150 can be sent separately or at the same time, and that, consequently, the response signals 135, 145 and 155 may also be generated separately or at the same time. Alternatively, a single polling signal may be used, in response to which the processing circuits 62 provide all the data described above.

It will be understood that, if separate signals are used, the sequence of the routine may differ from that described above since the different signals may be sent and received in any order, depending on the specific characteristics of the structure used.

In addition, the testing signals described above may be sent and received at desired intervals, selected according to requirements. For example, the apparatus 1 may be tested practically continuously by sequentially polling all the actuators 40, with the result that data is exchanged with each single actuator 40 every 5 seconds approximately.

In a preferred embodiment, the test routines are performed in response to a command from the auxiliary processor 200, thus generating input signals addressed to the processing unit 50 to activate the tests described above.

To test a single actuator 40 for correct operation, should the need arise, the CPU 52 can transmit to the actuator 40 concerned a test signal 170 containing a defined displacement for the actuator 40 itself. The resulting movement actually performed can be checked either directly by an operator working close to the actuator 40, or by the processing unit 50 for example, through one or more of the test routines described above.

The invention has important advantages.

First of all, it provides a control system for a parabolic surface whose overall wiring requirement is minimal since the motor drivers are positioned only a short distance away from the actuators and can control them directly. This also avoids the generation of interference signals.

Furthermore, thanks to the special type of test routines applied to each individual motor to check it for correct operation, it is possible to detect faults or malfunctions in the motors using a circuit structure that is not only very simple and economical but also compact and, hence, easy to position close to each motor.

Another advantage lies in the fact that the control system according to the invention as described above can easily be applied to existing aerials without necessitating substantial modifications to the structure of the apparatus to which the system is applied.

What is claimed is:

1. An apparatus for detecting electromagnetic radiation (300), in particular for radio astronomic applications, comprising:

a receiving element (10) designed to detect the electromagnetic radiation (300) of defined frequency and to generate as output corresponding signals addressed to a reception and processing centre;

a plurality of reflecting elements (20) which are associated with each other in such a way as to form the surface (30) designed to receive the electromagnetic radiation (300) and to direct it at the receiving element (10);

a plurality of actuators (40), each one positioned close to at least one of the reflecting elements (20) and operating on at least one reflecting element (20) in such a way as to vary the latter's position, each of the actuators (40) being equipped with:

a drive unit (41);

mechanical transmission means (42), connected to the drive unit (41) and to the respective reflecting element (20) in order to transmit to the reflecting element (20) the motion generated by the drive unit (41), the mechanical transmission means (42) being mobile between a plurality of working positions, each of which corresponds to at least one predetermined position of the respective reflecting element (20);

a processing unit (50) connected to the actuators (40) and designed to send to the actuators (40) control signals (100) enabling the drive units (41) of the actuators (40) to move the transmission means (42) connected to the drive units (41) between said working positions, each of the control signals (100) containing at least one positioning parameter **(100*a*) defining a working position of the transmission means (42)** of a target actuator;

the apparatus being characterised in that it further comprises a plurality of smart circuit blocks (60), each connected to a corresponding actuator (40) and located between the processing unit (50) and the drive unit (41) of the corresponding actuator (40), each of the smart circuit blocks (60) being designed to receive as input a control signal (100) from the processing unit (50) and to generate as output a corresponding displacement parameter (101) addressed to the drive unit (41) of the corresponding actuator (40) to position at least one reflecting element (20) connected to it.

2. The apparatus according to claim 1, characterised in that at least one of the smart circuit blocks (60) is positioned close to the drive unit (41) of the actuator (40) connected to it.

3. The apparatus according to claim 1, characterised in that each of a defined number of smart circuit blocks (60) is positioned close to the drive unit (41) of the actuator (40) connected to it.

4. The apparatus according to claim 1, characterised in that each of the smart circuit blocks (60) is positioned close to the drive unit (41) of the actuator (40) connected to it.

5. The apparatus according to claim 1, characterised in that the actuators (40) are positioned according to a radial structure (70) defined by a plurality of branches (80), each branch (80) having one end **(80*a*) connected to the processing unit (50) and comprising a predetermined number of actuators (40)** arranged in sequence.

6. The apparatus according to claim 5, characterised in that it further comprises a plurality of transmission channels (81), each of which is associated with one of the branches (80) and having an input **(81*a*) designed to receive from the processing unit (50) the control signals (100) addressed to at least one of the actuators (40) belonging to the branch (80), and a plurality of connecting legs (81*b*), each connected to one of the smart circuit blocks (60) connected to the actuators (40) belonging to the branch (80)**.

7. The apparatus according to claim 6, characterised in that each of the smart circuit blocks (60) comprises:

a main memory unit (61) designed to store the identification code (c) of the actuator (40) associated with the smart circuit block (60);

a processing circuit (62) having a first input **(62*a*) connected to the main memory unit (61) and a second input (62*b*) connected to one of the transmission channels (81) through one of its connecting legs (81*b*) in order to receive at least one of the control signals (100) containing an identification code (100*b*) of a target actuator, the processing circuit (62)** being designed to:

receive the control signal (100);

compare the identification code (c) stored in the main memory unit (61) with the identification code **(100*b*) contained in the control signal (100)**;

check whether the identification code (c) stored in the main memory unit (61) matches the identification code **(100*b*) contained in the control signal (100)**;

output a displacement parameter (101) which is input to the drive unit (41) of the actuator (40), so as to move the reflecting element or elements (20) associated with the actuator (40).

8. The apparatus according to claim 1, characterised in that it further comprises an interface unit (90), located between the processing unit (50) and the smart circuit blocks (60) and equipped with a plurality of addressing blocks (91), each of which is connected to the processing unit (50) and receives as input one of the control signals (100) addressed to a target actuator (40) and has a preset number of outputs **(91*a*), each connected to one of the transmission channels (81), at least one of the addressing blocks (91) being capable of outputting the control signal (100) through the transmission channel (81) associated with the branch (80) to which the target actuator (40)** belongs.

9. The apparatus according to claim 8, characterised in that the interface unit (90) is positioned close to the processing unit (50).

10. The apparatus according to claim 8, characterised in that each of the addressing blocks (91) consists of a demultiplexer.

11. The apparatus according to claim 1, characterised in that it further comprises an auxiliary processor (200), connected upstream of the processing unit (50) and designed to send to the processing unit (50) an auxiliary signal (110), containing at least one auxiliary parameter **(110*a*) defining a position of the surface (30), said processing unit (50)** being equipped with:

an associative memory unit (51) designed to store a plurality of records (400), each defined by a main parameter (p) corresponding to a defined position of the surface (30), each record (400) comprising a plurality of fields (410), each defined by the identification code (c) of a specific actuator (40) and containing a positioning parameter (100*a*) that identifies a position of the transmission means of that actuator (40) corresponding to the defined position of the surface (30);

a CPU (52), connected to the associative memory unit (51) and to the auxiliary processor (200) and designed to:

receive the auxiliary signal (110);

compare the auxiliary parameter (110*a*) contained in the auxiliary signal (110) with the main parameters (p) stored in the associative memory unit (51);

check whether the auxiliary parameter (110*a*) contained in the auxiliary signal (110) matches a specific main parameter (p) stored in the associative memory unit (51);

output at least one control signal (100), corresponding to the auxiliary signal (110), and containing the positioning parameters (100*a*) associated with the specific main parameter (p) and the identification codes (c) defining the fields (410) containing the positioning parameters (100*a*) associated with the specific main parameter (p) in the associative memory unit (51).

12. The apparatus according to claim 1, characterised in that the processing unit (50) is positioned close to the surface (30).

13. The apparatus according to claim 10, characterised in that the auxiliary processor (200) is located far away from the surface (30).

14. The apparatus according to claim 1, characterised in that the drive unit (41) comprises an electric motor (41*a*).

15. The apparatus according to claim 14, characterised in that the electric motor (41*a*) is a step-motor.

16. The apparatus according to claim 15, characterised in that each of the smart circuit blocks (60) is also equipped with a counting register (64) designed to contain at least one defined value representing a number of revolutions of the motor (41*a*) corresponding to the positioning parameter (100*a*) contained in the main signal (100) generated by the processing unit (50).

17. The apparatus according to claim 16, characterised in that each actuator (40) further comprises:

a cam (45) attached to a shaft of the motor (41*a*) and rotatable through a preset number of angular positions;

a detection device (46), preferably of optical type, located at the motor (41*a*) and associated with the cam (45), the detection device (46) being designed to detect the position of the cam (45) at at least one defined angular position and to send to the smart circuit block (60) one or more corresponding electric positioning pulses (47), the processing circuit (62) being connected to the counting register (64) and to the optical detection device (46) and being designed to:

receive one or more electrical pulses (47);

read the preset value stored in the counting register (64);

generate a fault signal (120), addressed to the processing unit (50) to communicate that a fault or malfunction has occurred, if the pulses (47) received are inconsistent with the preset value stored in the counting register (64).

18. The apparatus according to claim 17, characterised in that the defined angular position of the cam (45) corresponds to a whole number of revolutions performed by the shaft of the motor (41*a*).

19. The apparatus according to claim 18, characterised in that the processing circuit (62) generates the fault signal (120) if the defined value stored in the counting register (64) is a whole number and no positioning pulses (47) have been received, or if the defined value stored in the counting register (64) is not a whole number and one or more positioning pulses (47) have been received.

20. The apparatus according to claim 17, characterised in that the processing circuit (62) is designed to detect whether the preset value stored in the counting register (64) is a whole number, preferably by comparing the defined value with the whole number part of it.

21. The apparatus according to claim 1, characterised in that each reflecting element (20) has a substantially plate-like structure.

22. The apparatus according to claim 21, characterised in that the reflecting elements (20) are positioned side by side to form the surface (30).

23. The apparatus according to claim 1, characterised in that the mechanical transmission means (42) comprise:

an elongated transmission element (44) having a first end (44*a*) connected to a respective reflecting element (20) and a second end (44*b*), opposite the first end (44*a*), the transmission element (44) being mobile in a direction that is substantially parallel to its longitudinal extension;

a conversion mechanism (43), which is connected to the second end (44*b*) of the transmission element (44) and to the drive unit (41) and which converts the rotational motion of the drive unit (41) into the translational motion of the transmission element (44).

24. The apparatus according to claim 23, characterised in that the transmission means (42) further comprise a link plate (48), attached at the first end (44*a*) of the transmission element (44) and connected to a respective reflecting element (20).

25. The apparatus according to claim 24, characterised in that the link plate (48) presents a main through hole (49), the transmission element (44) passing through the main through hole (49) at least partially and being fixed to the link plate (48) at the main through hole (49).

26. The apparatus according to claim 24, characterised in that the link plate (48) is connected to a plurality of reflecting elements (20).

27. The apparatus according to claim 1, characterised in that each of the actuators (40) can be driven between an operative condition in which the transmission means (42) can be moved and a non-operative condition in which the transmission means (42) cannot be moved.

28. The apparatus according to claim 27, characterised in that each of the smart circuit blocks (60) further comprises a status register (65) designed to contain a status parameter (s) representing the condition of the actuator (40) connected to that block (60).

29. The apparatus according to claim 28, characterised in that the CPU (52) of the processing unit (50) is also designed to do the following, preferably in response to a command from the auxiliary processor (200):

send, at defined intervals, a first polling signal (130) to one or more of the smart circuit blocks (60), to obtain information on the state of the actuators (40) connected to the circuit blocks (60);

receive from one or more of the smart circuit blocks (60) a corresponding first response signal (135) containing the status parameter (s);

the processing circuit (62) of each of the smart circuit blocks (60) being designed to:

receive the first polling signal (130) from the processing unit (50);

read the status register (65);

output a first response signal (135) addressed to the processing unit (50) and containing the status parameter (s).

30. The apparatus according to claim 29, characterised in that the processing unit (50) further comprises a status memory unit (53), connected to the CPU (52) and designed to store a preset number of defined parameters, each associated with a corresponding actuator (40) and representing the condition of the actuator (40), the CPU (52) being preferably also designed, preferably in response to a command from the auxiliary processor (200), to compare the status parameters (s) received through the first response signals (135) with the defined parameters stored in the status memory unit (53).

31. The apparatus according to claim 1, characterised in that the CPU (52) of the processing unit (50) is also designed to do the following, preferably in response to a command from the auxiliary processor (200):

to send, at defined intervals, a second polling signal (140) to one or more of the smart circuit blocks (60) to check whether the processing circuit (62) has read the counting register (64) correctly;

receive from each of the smart circuit blocks (60) a corresponding second response signal (145) containing the defined value stored in the counting register (64);

the processing circuit (62) of each of the smart circuit blocks (60) being designed to:

receive the second polling signal (140);

read the defined value stored in the counting register (64);

output the second response signal (145) addressed to the processing unit (50) and containing the defined value stored in the counting register (64).

32. The apparatus according to claim 31, characterised in that the CPU (52) of the processing unit (50) is also designed, preferably in response to a command from the auxiliary processor (200), to compare the value contained in the second response signal (145) with the corresponding positioning parameter (100*a*) stored in the associative memory unit (51).

33. The apparatus according to claim 1, characterised in that the CPU (52) is also designed to do the following, preferably in response to a command from the auxiliary processor (200):

to send, at defined intervals, a third polling signal (150) to one or more of the smart circuit blocks (60) to check whether the processing circuit (62) has received one or more pulses (47);

to receive from each of the smart circuit blocks (60) a corresponding third response signal (155) containing information relating to the reception of the pulses (47) by the processing circuit (62);

the processing circuit (62) of each of the smart circuit blocks (60) being designed to:

receive the third polling signal (150);

output the corresponding third response signal (155) to communicate information relating to the reception of the pulses (47).

34. The apparatus according to claim 1, characterised in that the CPU (52), preferably in response to a command from the auxiliary processor (200), is designed to test an actuator (40) by sending a test signal (170) to the smart circuit block (60) associated with that actuator (40), said test signal (170) containing a preset movement for the actuator (40) to be tested.

35. An apparatus for detecting electromagnetic radiation (300), in particular for radio astronomic applications, characterised in that it comprises:

a receiving element (10) designed to detect the electromagnetic radiation (300) of defined frequency and to generate as output corresponding signals addressed to a reception and processing centre;

a plurality of reflecting elements (20) which are associated with each other in such a way as to form the surface (30) designed to receive the electromagnetic radiation (300) and to direct it at the receiving element (10);

a plurality of actuators (40), each one positioned close to a defined number of respective reflecting elements (20) and operating on the reflecting elements (20) in such a way as to vary their position, each of the actuators (40) being equipped with:

a drive unit (41);

mechanical transmission means (42), connected to the drive unit (41) and to the respective reflecting elements (20) in order to transmit to the reflecting elements (20) the motion generated by the drive unit (41), the mechanical transmission means (42) being mobile between a plurality of working positions, each of which corresponds to at least one predetermined position of the respective reflecting elements (20);

a processing unit (50) located close to the surface (30) and connected to the actuators (40), said processing unit (50) being designed to send to the actuators (40) control signals (100) enabling the drive units (41) of the actuators (40) to move the transmission means (42) connected to the drive units (41) between said working positions, each of the control signals (100) containing at least one positioning parameter (100*a*) defining a working position of the transmission means (42) of a target actuator (40);

a plurality of smart circuit blocks (60), each connected to a corresponding actuator (40) and located between the processing unit (50) and the drive unit (41) of the corresponding actuator (40), each of the smart circuit blocks (60) being designed to receive as input a control signal (100) from the processing unit (50) and to generate as output a corresponding displacement parameter (101) addressed to the drive unit (41) of the corresponding actuator (40) to position the respective reflecting elements (20), each of the smart circuit blocks (60) being equipped with:

a main memory unit (61) designed to store the identification code (c) of the actuator (40) associated with the smart circuit block (60);

a processing circuit (62) having a first input (62*a*) connected to the main memory unit (61) and a second input (62*b*) connected to the processing unit (50) in order to receive at least one of the control signals (100) containing an identification code (100*b*) of a target actuator (40), the processing circuit (62) being designed to:

receive the control signal (100);

compare the identification code (c) stored in the main memory unit (61) with the identification code (100*b*) contained in the control signal (100);

check whether the identification code (c) stored in the main memory unit (61) matches the identification code (100*b*) contained in the control signal (100);

output a displacement parameter (101) which is input to the drive unit (41) of the actuator (40), so as to move the respective reflecting elements (20);

an auxiliary processor (200), connected to the processing unit (50) and designed to send to the processing unit (50) an auxiliary signal (110), containing at least one auxiliary parameter (110*a*) defining a position of the surface (30), said processing unit (50) being equipped with:

an associative memory unit (51) designed to store a plurality of records (400), each defined by a main parameter (p) corresponding to a defined position of the surface (30), each record (400) comprising a plurality of fields (410), each defined by the identification code (c) of a specific actuator (40) and containing a positioning parameter (100*a*) that identifies a position of the transmission means (42) of that actuator (40) corresponding to the defined position of the surface (30);

a CPU (52), connected to the associative memory unit (51) and to the auxiliary processor (200) and designed to:

receive the auxiliary signal (110);

compare the auxiliary parameter (110*a*) contained in the auxiliary signal (110) with the main parameters (p) stored in the associative memory unit (51);

check whether the auxiliary parameter (110*a*) contained in the auxiliary signal (110) matches a specific main parameter (p) stored in the associative memory unit (51);

output at least one control signal (100), corresponding to the auxiliary signal (110), and containing the positioning parameters (100*a*) associated with the specific main parameter (p) and the identification codes (c) defining the fields (410) containing the positioning parameters (100*a*) associated with the specific main parameter (p).

* * * * *